United States Patent [19]

Goslin

[11] Patent Number: 4,932,824

[45] Date of Patent: Jun. 12, 1990

[54] CAP FEEDER

[75] Inventor: Kevin P. Goslin, Raynham, Mass.

[73] Assignee: Pneumatic Scale Corporation, Quincy, Mass.

[21] Appl. No.: 294,279

[22] Filed: Jan. 6, 1989

[51] Int. Cl.[5] ..... B65B 7/28

[52] U.S. Cl. ..... 414/224; 193/27; 53/313; 53/306

[58] Field of Search ..... 53/313, 315, 314, 316, 53/310, 306; 414/224; 198/463.4, 532; 193/27; 29/773

[56] References Cited

U.S. PATENT DOCUMENTS

| | | | |
|---|---|---|---|
| 1,955,704 | 4/1934 | Bahelka | 53/313 |
| 2,481,508 | 9/1949 | Gschwend | 29/773 |
| 2,738,118 | 3/1956 | Hall | 53/306 |
| 2,917,880 | 12/1959 | Hohl | 53/314 |
| 2,996,865 | 8/1961 | Hohl et al. | 53/315 |
| 3,114,159 | 12/1963 | Yoshikawa . | |
| 3,274,748 | 9/1966 | Roberts et al. | 53/315 |
| 3,280,534 | 10/1966 | Hildebrandt et al. | 53/315 |
| 3,380,225 | 4/1968 | Ochs et al. | 53/315 |
| 3,714,760 | 2/1973 | Roberts et al. . | |
| 3,807,133 | 4/1974 | Simonazzi . | |
| 3,975,886 | 8/1976 | Waters . | |
| 3,983,616 | 10/1976 | Duke | 53/315 |
| 4,346,515 | 8/1982 | Lodding et al. | 53/315 |
| 4,716,708 | 1/1988 | Ochs | 53/315 |

*Primary Examiner*—Frank E. Werner
*Assistant Examiner*—James T. Eller
*Attorney, Agent, or Firm*—Robert M. Asher

[57] ABSTRACT

This invention, as herein illustrated, is for delivering caps in succession, one at a time, to a distributor for application to the tops of containers. There is an end wall at the bottom of a chute against which the bottom cap in the pick-off position abuts. The force against the bottom cap is reduced by providing a bent portion near the lower end of the chute.

18 Claims, 3 Drawing Sheets

CAP FEEDER

BACKGROUND OF THE INVENTION

Heretofore, the delivery of caps for application to the tops of containers has been accomplished by gravitationally feeding the caps downwardly along an inclined chute onto jigs movable along a horizontal path relative to the inclined path. Due to the inclination of the chute, force is exerted by the caps against each other down the chute. In accordance with the conventional feed chute, caps are delivered in a straight line, coming to rest in the pick-off position on a centrally-located finger. The bottom cap is picked off in the same direction as the force exerted by the caps. Due to high speeds of over 400 caps per minute, there is a great deal of pressure exerted on the bottom caps. This pressure creates a tendency when one cap is picked off for the next cap to be pushed out by the force from all of the caps behind it. If more than one cap pops out of the chute at one time, the production line may be interrupted or caps may disadvantageously accumulate on the floor.

Furthermore, conventional feeders generally experience pulsating movement back through the line of caps in the chute when large diameter caps are being fed. The pulsating is caused as the bottom cap alternates between waiting and moving when the jig moves by the pick-off position. These pulsations add to the pressure exerted against the bottom cap, further aggravating the problem of extra caps being ejected.

It is the purpose of this invention to so design a cap feeding structure as to insure that only one cap at a time is picked from the chute by the jig at high speeds and to permit higher speeds of operation.

SUMMARY OF THE INVENTION

As herein illustrated, the apparatus comprises an inclined rectilinear chute for receiving at its upper end caps for movement downwardly thereon is single file, the chute being provided with an end wall at its lower end and with a lateral opening at its lower end through which the caps at the lower end engaged with the end wall can be removed from the chute one at a time without entraining the succeeding cap, means situated in said lateal opening at its lower end for constraining the caps within the chute and a picker adjacent the lower end of the chute movable relative to said lower end in a direction to pick the caps from the chute one at a time from the constraining means. There are transversely-spaced guides at opposite sides of the lateral opening extending therefrom in the direction of movement of the picker and a presser plate supported above and transversely of the guides, spring-biased downwardly relative to the guides. There is means at the upper side of the chute adjacent the lower end and centered with respect to said lateral opening for discharging air under pressure against the top of a cap situated at the lower end in engagement with the constraining means. The chute is provided with an opening at the bottom side and the constraining means comprises a finger extending transversely of the opening. The finger has an upturned nub at its distal end.

BRIEF DESCRIPTION OF THE DRAWINGS

The invention will now be described with reference to the accompanying drawings, wherein.

DESRIPTION OF PREFERRED EMBODIMENTS

Figure 1:
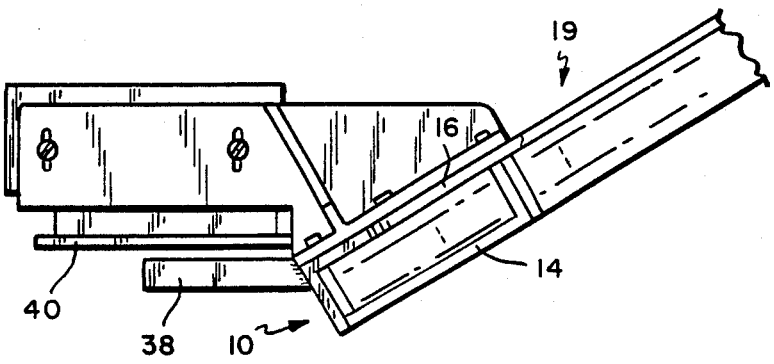
FIG. 1 is a side elevation of the cap feeding means.

Referring to the drawings, FIGS. 4 TO 7, there is shown structure for feeding caps 2 onto jigs 4 spaced about a circular support comprising a chute 10 of rectangular cross section, transversely and longitudinally-inclined as shown in FIGS. 1, 4, 5, 6 and 7. The chute is of a width and height to receive the caps 2.

The inlet end of the chute 10 may be a great distance away from the bottom of the chute illustrated in the Figures. The chute can wind around a factory before it reaches its destination at the bottom of the cap feeder. An elongated rectilinear portion 19 of the chute is shown in part in the Figures. The bottom side 14 of the chute supports the caps. Above the bottom side 14, there is an extension of the top side 16 of the chute. The chute 10 serves to gravitationally guide a cap downwardly into a bent portion 18 of the chute 10. Transversely-spaced guides shown in dot and dash lines constrain lateral movement of the caps as they gravitate into the chute 10 and through the bent portion 18. Since the two caps in the bent portion are at an angle relative to their direction of movement, only a portion of the force created by the line of caps is transmitted to the bottom cap. In accordance with a preferred embodiment of the present invention, the bent portion forms a right angle. However, other embodiments are contemplated by the present invention, including making the bent portion a curve or making the bent portion cover a larger portion of the chute so as to include several caps at a time. Also, other angles besides a right angle may be used.

Figure 2:
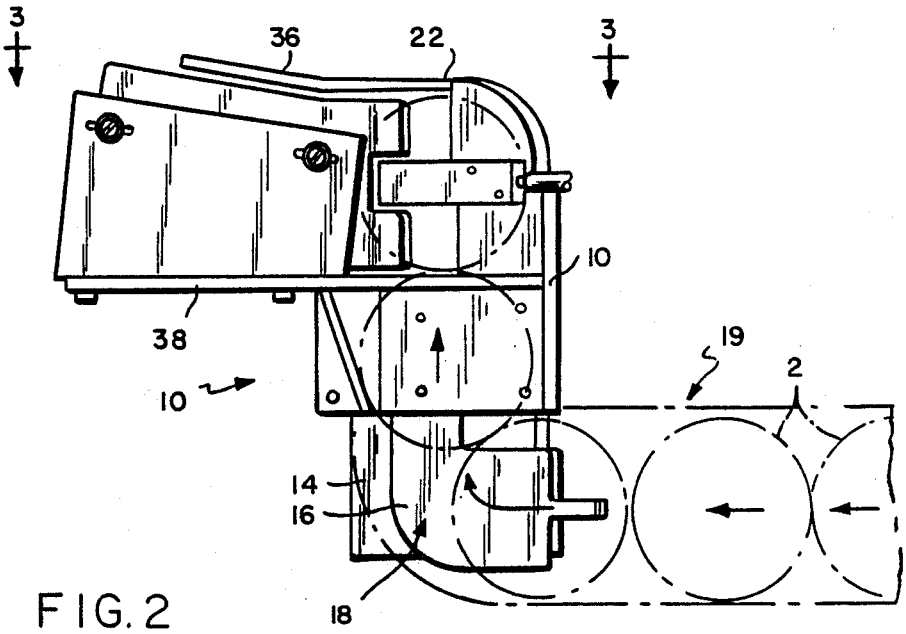
FIG. 2 is a top plan view of the cap feeding means.
Figure 3:
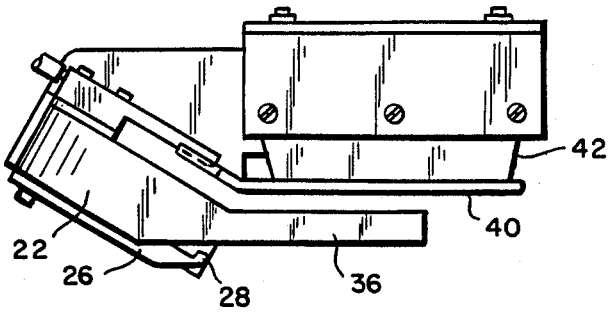
FIG. 3 is an elevation taken on the line 3—3 of FIG. 2.
Figure 4:
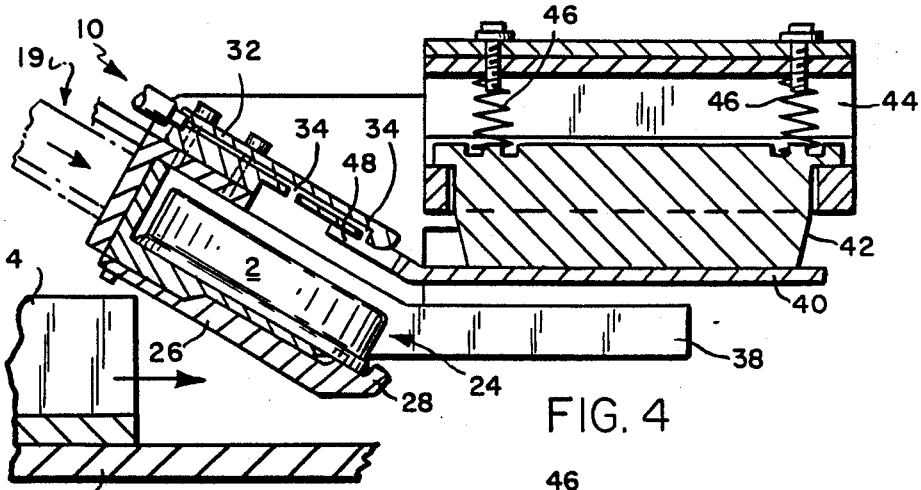
FIG. 4 is a section taken on the line 4—4 of FIG. 3.

In accordance with the present invention, there is an end wall 22, FIG. 2, at the lower end of the chute which extends transversely of the chute. In the presently preferred embodiment, only two caps fit between the end wall 22 and the bent portion 18. The lower end of the chute at the lower side contains a lateral opening 24, FIGS. 4 to 7, corresponding to the diameter of the caps within which there is mounted midway between the opposite sides of the opening an inclined supporting finger 26 having at its lower end a lip 28 which prevents the cap at the lower end from falling out of the chute. Advantageously, the force of the caps in the chute is directed into the end wall 22 rather than down the finger 26 toward the lip 28. Thus, when one cap is picked off, the one behind it is pushed against the end wall, putting it in the pick-off position. In this manner, only one cap is picked off at a time. The upper side 16 of the chute is parallel to the lower side 14 and contains an opening within which is supported a bracket 32 bolted to the upper side and extending downwardly parallel to the lower side. Two air jet nozzles 34 are fixed to the bracket 32 to project air downwardly against the top of a cap resting within the chute on the finger 26.

There are transversely-spaced elongate guides 36, 38, FIG. 2, spaced from each other a distance corresponding to substantially the diameter of a cap extending from the opening 24. The guides 36 and 38 constrain lateral movement of the caps as they are moved onto the jigs 4.

Between the guides 36 and 38, there is a presser plate 40 yieldably supported by a vertically-disposed web 42 mounted to a bracket 44 for vertical movement and spring-biased in a downward direction by springs 46—46. The plate 40 is supported in a substantially horizontal position parallell to the upper edges of the guides 36 and 38 and has at one end an inclined bifurcated lip 48 which straddles the lower end of the bracket 32 and is substantially parallel to the finger 26.

Figure 5:
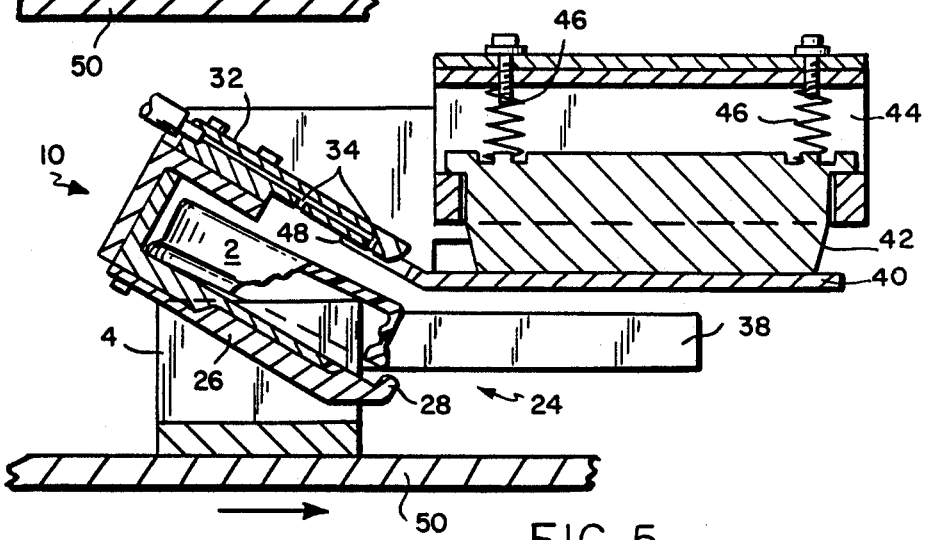
FIGS. 5, 6 and 7 show successive positions of the jig as it removes the caps from the lower end of the chute.
Figure 6:
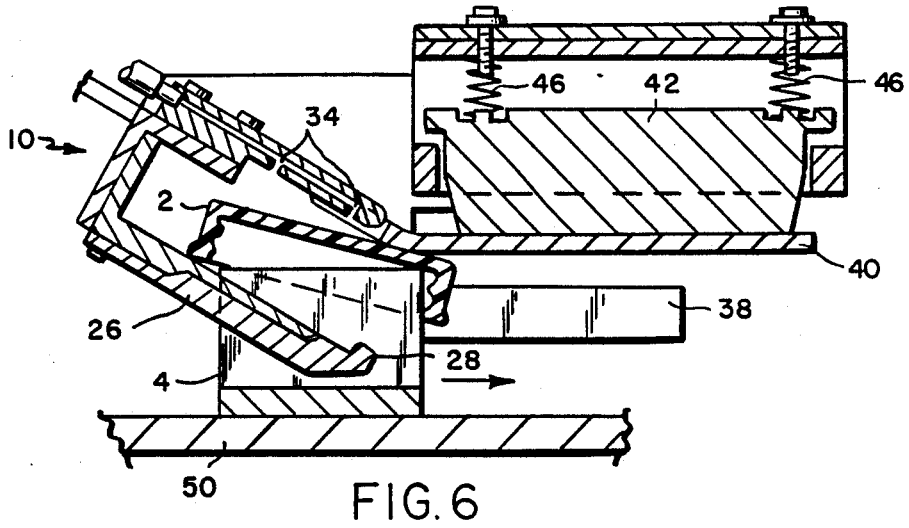
Figure 7:
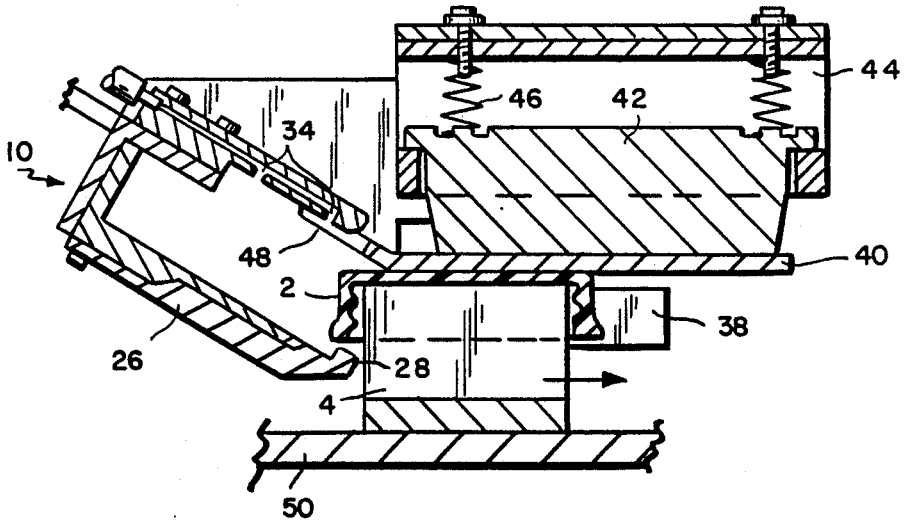

The jig 4 on which the caps are to be disposed is supported at a level such as to intercept the forward edge of a cap resting against the lip 28 and lift above the lip so that as the jig moves forwardly, the rear edge of the cap clears the lip 28, FIGS. 5, 6 and 7. The jig has a valley through its center which accommodates the finger 26. It is possible within the scope of this invention to have the jig function performed by the bottle or container to be capped. This would mean the finger 26 would have to be replaced by another means of holding the bottom cap in place. For example, the end wall can be provided at an acute angle relative to the incoming chute. This can hold the cap in place while the containers or bottles are moved through parallel to the end wall to pick off the caps one at a time.

There are a plurality of jigs 4 mounted circularly about a rotating platform 50 in peripherally-spaced relation of each other such that each jig clears the lip 28 before the succeeding lip engages a succeeding cap.

While the jigs 4 as herein illustrated are mounted on a rotating platform 50 for rotation about a vertical axis, it is possible to mount the jigs on a support which is movable rectilinearly.

As thus constructed, the endmost cap in the chute 10 to be discharged is disposed laterally of the succeeding caps and can be disengaged from the chute without entraining the succeeding cap in a direction to discharge it together with the cap being discharged. Hence, the problem with prior cap feeding structure of discharging two or more caps at a time is avoided.

Furthermore, since the caps in the present invention do not all move in a straight line one behind the other, the pulsation effects caused in the prior art are no longer a problem. As the bottom cap is being discharged, the cap next to it cannot move at the same speed as the bottom cap since the trailing portion of that cap blocks the cap from shifting over completely. Also, because of the bent portion and the lateral discharge opening, the caps may be caused to rotate as they move. Thus, all of the forces pushing on the caps are not directed to translational movement and the consequent pulsation phenomena. Instead, some of the force on the caps goes into the rotational movement of the caps and some force is exerted against the guide walls of the chute.

It should be understood that the present disclosure is for the purpose of illustration only and includes all modifications or improvements which fall within the scope of the appended claims.

What is a claimed is:

1. Apparatus comprising an inclined chute for receiving caps at an upper end of said chute for gravitational movement of said caps downwardly thereon in single file, said chute being provided with an end wall at a lower end against which the file of caps is urged and with a lateral opening at said lower end in a plane essentially perpendicular to the plane of said end walls through which the cap at the lower end engaged with the end wall can be removed from the chute in a direction perpendicular to an axis of rotation of the cap, means situated in said lateral opening at said lower end for preventing the cap engaged with the end wall at said lower end of the chute from falling out of the chute and jig means adjacent the lower end of the chute movable relative to said lower end in a direction to pick caps from the chute one at a time from the preventing means.

2. Apparatus according to claim 1 wherein said chute comprises a rectilinear portion and a bent portion, the rectilinear portion feeding caps as they move from the upper end of the chute to the bent portion, said bent portion being provided to reduce the pressure applied by the caps against the end wall.

3. Apparatus according to claim 2 wherein only two caps fit in said chute between the end wall and the bent portion.

4. Apparatus according to claim 2 wherein the bent portion comprises a right angle in said chute.

5. Apparatus according to claim 1 further comprising transversely-spaced guides at opposite sides of said lateral opening extending therefrom in the direction of movement of the jig means to center the cap picked off from the chute with respect to jig the means.

6. Apparatus according to claim 5 wherein a presser plate is supported above and transversely of said guides, spring-biased downwardly relative to said guides to direct the cap picked off from the chute downward onto the jig means.

7. Apparatus according to claim 6 wherein said presser plate has an upwardly-inclined lip at the end adjacent said lateral opening.

8. Apparatus according to claim 7 wherein the lower end of the chute is provided with an opening in the top side and the inclined lip extends into said opening parallel to the top side.

9. Apparatus according to claim 1 wherein there is means at the top side of the chute adjacent the lower end for discharging air under pressure against the top of a cap situated at the lower end, in engagement with the preventing means.

10. Apparatus according to claim 1 wherein the preventing means comprises a finger extending from beneath said lateral opening and said finger having an upturned lip at a distal end thereof to partially obstruct said opening.

11. Apparatus according to claim 9 wherein said lower end of the chute has top and bottom sides, the means for discharging air are jets situated in the top side, and the preventing means is a finger situated in the bottom side.

12. Apparatus comprising a support defining an inclined passage open at an upper end and blocked at a lower end for receiving caps for gravitational movement of the caps from the open upper end to the blocked lower end, said passage containing a lateral discharge opening at its block lower end extending in a plane essentially parallel to the direction of movement of the file of caps adjacent said lateral discharge opening to permit removal of a cap from the lower end in a direction perpendicular to the axis of rotation of the cap, a stop member centered and fixed in said lateral opening for constraining caps at the lower end of the passage from movement through the lateral opening and jig means movable along a horizontal path relative to said lateral discharge opening at a level to disengage caps from the stop member to remove the disengaged caps one at a time from the lower end of the passage through said lateral opening.

13. Apparatus according to claim 12 comprising means, extending from above the lateral opening, for pressing the caps down onto the jig means as the caps emerge from the discharge opening.

14. Apparatus according to claim 13 comprising transversely-spaced guides at opposite sides of the lateral discharge opening for centering the caps with respect to the jig means as they emerge from the discharge opening.

15. Apparatus according to claim 14 wherein at the upper side of the passage adjacent the lateral opening, there is means for ejecting jets of air downwardly on the top of the cap at the lower end of the passage resting on the stop member.

16. Apparatus according to claim 12 wherein said passage comprises an elongated rectilinear portion and a bent portion, said caps moving through said passage from the upper end through the elongated rectilinear portion followed by the bent portion and into the blocked lower end, said bent portion being provided to reduce the pressure against the blocked lower end applied by the caps.

17. Apparatus according to claim 16 wherein only two caps fit in the passage from the blocked lower end to the bent portion.

18. Apparatus according to claim 16 wherein the bent portion comprises a right angle in said passage.

* * * * *